US008062584B2

(12) United States Patent
Hamada et al.

(10) Patent No.: US 8,062,584 B2
(45) Date of Patent: Nov. 22, 2011

(54) FERRITIC STAINLESS STEEL SHEET SUPERIOR IN HEAT RESISTANCE

(75) Inventors: Junichi Hamada, Tokyo (JP); Haruhiko Kajimura, Tokyo (JP); Toshio Tanoue, Tokyo (JP); Fumio Fudanoki, Tokyo (JP); Yoshiharu Inoue, Tokyo (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 0 days.

(21) Appl. No.: 12/227,619

(22) PCT Filed: Dec. 26, 2007

(86) PCT No.: PCT/JP2007/075378

§ 371 (c)(1),
(2), (4) Date: Nov. 21, 2008

(87) PCT Pub. No.: WO2008/105134

PCT Pub. Date: Sep. 4, 2008

(65) Prior Publication Data

US 2009/0092513 A1 Apr. 9, 2009

(30) Foreign Application Priority Data

Feb. 26, 2007 (JP) ..... 2007-045449
Nov. 9, 2007 (JP) ..... 2007-292054

(51) Int. Cl.
*C22C 38/18* (2006.01)

(52) U.S. Cl. ..... 420/34; 420/8; 420/61; 420/64; 420/67; 420/68

(58) Field of Classification Search ..... 420/8, 34, 420/60–64, 67–69
See application file for complete search history.

(56) References Cited

U.S. PATENT DOCUMENTS 5,861,068 A * 1/1999 Hasegawa et al. ..... 148/326

(Continued)

FOREIGN PATENT DOCUMENTS

JP 09-279312 10/1997

(Continued)

OTHER PUBLICATIONS

Douthett, Joseph, "Automotive Exhaust System Corrosion," Corrosion: Environments and Industries, vol. 13C, ASM Handbook, ASM International, 2006, p. 519-530.*

(Continued)

*Primary Examiner* — Stanley Silverman
*Assistant Examiner* — Brian Walck
(74) *Attorney, Agent, or Firm* — Kenyon & Kenyon, LLP

(57) ABSTRACT

The present invention provides, as a material superior in heat resistance in a hot environment where the maximum temperature of the exhaust gas becomes 750 to 900° C., ferritic stainless steel sheet superior in heat resistance in a broad temperature region of 750 to 900° C. with long term stability by a smaller amount of addition of Mo than SUS444 containing about 2% of expensive Mo, that is, ferritic stainless steel sheet superior in heat resistance characterized by containing, by mass %, C: 0.01% or less, N: 0.02% or less, Si: 0.05 to 1%, Mn: 0.1 to 2%, Cr: 10 to 30%, Mo: 0.1 to 1%, Cu: 1 to 2%, Nb: 0.2 to 0.7%, Ti: 0.01 to 0.3%, and B: 0.0002 to 0.0050%, having a balance of Fe and unavoidable impurities, and having a 0.2% yield strength at 750° C. of 70 MPa or more.

8 Claims, 2 Drawing Sheets

U.S. PATENT DOCUMENTS

| | | | | |
|---|---|---|---|---|
| 2004/0244884 | A1* | 12/2004 | Hideshima et al. | 148/610 |
| 2005/0161133 | A1* | 7/2005 | Hamada et al. | 148/602 |
| 2006/0225820 | A1* | 10/2006 | Hamada et al. | 148/610 |

FOREIGN PATENT DOCUMENTS

| | | |
|---|---|---|
| JP | 10-204590 | 8/1998 |
| JP | 2000-169943 | 6/2000 |
| JP | 2000-297355 | 10/2000 |
| JP | 2000-303149 | 10/2000 |
| JP | 3397167 | 2/2003 |
| JP | 3468156 | 9/2003 |
| JP | 2005-298854 | 10/2005 |
| JP | 2006-037176 | 2/2006 |
| WO | 2003/004714 | 1/2003 |
| WO | 2004-053171 | 6/2004 |

OTHER PUBLICATIONS

International Search Report dated Apr. 8, 2008 issued in corresponding PCT Application No. PCT/JP2007/075378.

* cited by examiner

FERRITIC STAINLESS STEEL SHEET SUPERIOR IN HEAT RESISTANCE

TECHNICAL FIELD

The present invention relates to ferritic stainless steel sheet superior in heat resistance optimum for use as an exhaust gas system member requiring high temperature strength and oxidation resistance.

BACKGROUND ART

An exhaust manifold, front pipe, and center pipe, or other exhaust system member of an automobile carries high temperature exhaust gas exhausted from an engine, so the material forming the exhaust member is required to have oxidation resistance, high temperature strength, heat fatigue characteristics, and various other properties.

In the past, the general practice was to use cast iron for the automobile exhaust members, but from the viewpoint of toughening of exhaust-gas regulations, improvement of engine performance, lightening of the weight of the chassis, etc., stainless steel exhaust manifolds have come into use. The exhaust gas temperature differs depending on the car model, but in recent years, the temperature has mostly been 750 to 900° C. A material having excellent high temperature strength and oxidation resistance in an environment where the material is used for a long time in this temperature region has been demanded.

Among stainless steels, austenitic stainless steel is superior in heat resistance and workability, but has a large coefficient of heat expansion, so is susceptible to heat fatigue breakage when used for a member such as an exhaust manifold which is repeatedly heated and cooled.

On the other hand, ferritic stainless steel has a smaller coefficient of heat expansion compared with austenitic stainless steel, so is superior in heat fatigue characteristics and scale peeling resistance. Further, compared with austenitic stainless steel, it does not contain Ni, so the cost of the material is low and it is in general use. However, ferritic stainless steel is lower than austenitic stainless steel in high temperature strength, so technology has been developed for improving the high temperature strength. For example, there are SUS430J1 (Nb steel), Nb—Si steel, and SUS444 (Nb—Mo steel). These improve the high temperature strength by basically addition of Nb and by addition of Si and Mo. Among these, SUS444 has about 2% of Mo added to it, so is highest in strength, but has the problems that it is inferior in workability and contains a large amount of expensive Mo, so is high in cost.

Various additive elements are being studied in addition to the above alloys. Japanese Patent Publication (A) No. 2006-37176, International Publication WO2003/004714, Japanese Patent No. 3468156, and Japanese Patent No. 3397167 disclose the technology of addition of Cu or Cu—V. Regarding the addition of Cu in Japanese Patent Publication (A) No. 2006-37176, addition of 0.5% or less is being studied for improvement of the low temperature toughness. It is not addition from the viewpoint of the heat resistance. International Publication WO2003/004714, Japanese Patent No. 3468156, and Japanese Patent No. 3397167 disclose the technology of utilizing precipitation hardening by Cu precipitates to improve the high temperature strength in the 600° C. or 700 to 800° C. temperature region. Japanese Patent Publication (A) No. 2006-37176, International Publication WO2003/004714, Japanese Patent Publication (A) No. 9-279312, Japanese Patent Publication (A) No. 2000-169943, and Japanese Patent Publication (A) No. 10-204590 disclose steel containing B as ferritic stainless steel superior in high temperature characteristics. The prior art for improvement of the high temperature strength using the addition of Cu utilizes Cu precipitates, but when Cu precipitates are exposed to a high temperature over a long time, coarsening rapidly occurs due to agglomeration and merger of precipitates, so there is the problem that the precipitation strengthening ability ends up remarkably falling. When undergoing the heat cycle accompanying the starting and stopping of the engine like an exhaust manifold, the danger arises that the high temperature strength will remarkably fall at the stage of long term use and heat fatigue breakage will occur.

Further, depending on the engine structure, sometimes the temperature of the exhaust gas will rise up to about 900° C. As described in International Publication WO2003/004714, with the addition of Cu or the composite addition of Cu—V, the yield strength at 900° C. does not reach the SUS444 level, so sufficient reliability is not obtained as an exhaust part. In past discoveries, B was added to improve the workability and improved the grain boundary strength due to grain boundary segregation so as to improve the secondary workability. The effect on the high temperature characteristics was not clear.

DISCLOSURE OF INVENTION

The present invention has as its object the provision of ferritic stainless steel sheet superior in heat resistance stably over a long period of time in a broad temperature region of 750 to 900° C. as a material superior in heat resistance, in particular in a hot environment with a maximum temperature of exhaust gas of 750 to 900° C., by addition of a smaller amount of expensive Mo than SUS444 containing about 2%.

To solve this problem, the inventors examined in detail the expression of high temperature strength at 750° C. to 900° C. Further, they took into consideration long term use and an environment subject to a heat cycle and carefully studied not only the deformation characteristics in the high temperature region, but also how the deformation characteristics in the low and medium temperature region act on heat fatigue life. Further, they engaged in various studies to achieve the above object and as a result obtained the following discovery: As this characterizing feature, a large amount of precipitate is formed in the temperature region of about 750° C., so addition of an alloy for controlling the form of the precipitate is effective. Specifically, by making the ϵ-Cu precipitating due to the addition of the Nb-based precipitate Laves phase and Cu finely precipitate, suppression of the drop in strength due to the use of precipitation strengthening and aging heat treatment is effective for long term stability as an exhaust member. The inventors studied the fine diffusion of the Laves phase and ϵ-Cu and as a result learned that composite addition of Nb—Cu—B is effective for fine precipitation and suppression of coarsening.

Furthermore, for use in the high temperature region of about 900° C. where the precipitate will dissolve, the precipitation strengthening ability falls, so securing the amount of solid solution of the elements contributing to strengthening is important. Dissolved Nb has a high strengthening ability, but dissolved Cu has a low strengthening ability, so improvement of strength in the high temperature region was realized by a finer amount of addition of Mo than SUS444. Due to this, it has been difficult to obtain a good high temperature strength at 900° C., at which a high temperature strength on a par with SUS444 could not be secured, in the Nb—Cu steel with less than Mo: 0.1% disclosed in International Publication WO2003/004714. That is, by adding Nb—Cu—B, it becomes possible to provide a low Mo ingredient low cost steel material giving a high temperature strength in the temperature region of about 750° C. and having a heat resistance in the high temperature region near 900° C., the upper limit of the applicable temperature, which had been a problem in conventional Cu or Cu—V steel, equal to that of the SUS444 high strength material currently being used.

In the present invention, the inventors discovered that the addition of B causes the precipitate formed in a high temperature atmosphere to finely diffuse and greatly contributes to high temperature strength. That is, in the present invention, they discovered a different action and effect from the conventional inventions in the effect of Cu or B on the high temperature strength and improved the high temperature strength. Further, they invented ferritic stainless steel sheet superior in heat resistance making the precipitate finer and exhibiting the maximum extent of solution strengthening effect by the addition of a finer amount of Mo than the amount of Mo contained in SUS444 and the composite addition of Nb—Cu—B. Furthermore, in their studies on the oxidation resistance, they discovered that Cu steel tends be more susceptible to abnormal oxidation or scale peeling in a temperature region of 900° C. or more compared with Cu steel or Cu—V steel. They discovered that this can be prevented by adding a suitable amount of Si and made possible the provision of a steel material having oxidation resistance stable up to the high temperature region.

The gist of the present invention for solving these problems is as follows:

(1) Ferritic stainless steel sheet superior in heat resistance characterized by containing, by mass %, C: 0.01% or less, N: 0.02% or less, Si: 0.05 to 1%, Mn: 0.1 to 2%, Cr: 10 to 30%, Mo: 0.1 to 1%, Cu: 1 to 2%, Nb: 0.2 to 0.7%, Ti: 0.01 to 0.3%, and B: 0.0002 to 0.0050%, having a balance of Fe and unavoidable impurities, and having a 0.2% yield strength at 750° C. of 70 MPa or more.

(2) Ferritic stainless steel sheet superior in heat resistance as set forth in claim 1 characterized by further containing, by mass %, one or more of Al: 3% or less, V: 1% or less, W: 3% or less, Sn: 1%, and Zr: 1% or less.

(3) Ferritic stainless steel sheet superior in heat resistance as set forth in claim 1 or 2 characterized in that a 0.2% yield strength at 900° C. is 20 MPa or more.

(4) Ferritic stainless steel sheet superior in heat resistance as set forth in claim 1 or 2 characterized in that a 0.2% yield strength at 750° C. after 100 hr aging heat treatment at 750° C. is 40 MPa or more and a 0.2% yield strength at 900° C. after 100 hr aging heat treatment at 900° C. is 15 MPa or more.

BEST MODE FOR CARRYING OUT THE INVENTION

Figure 1:
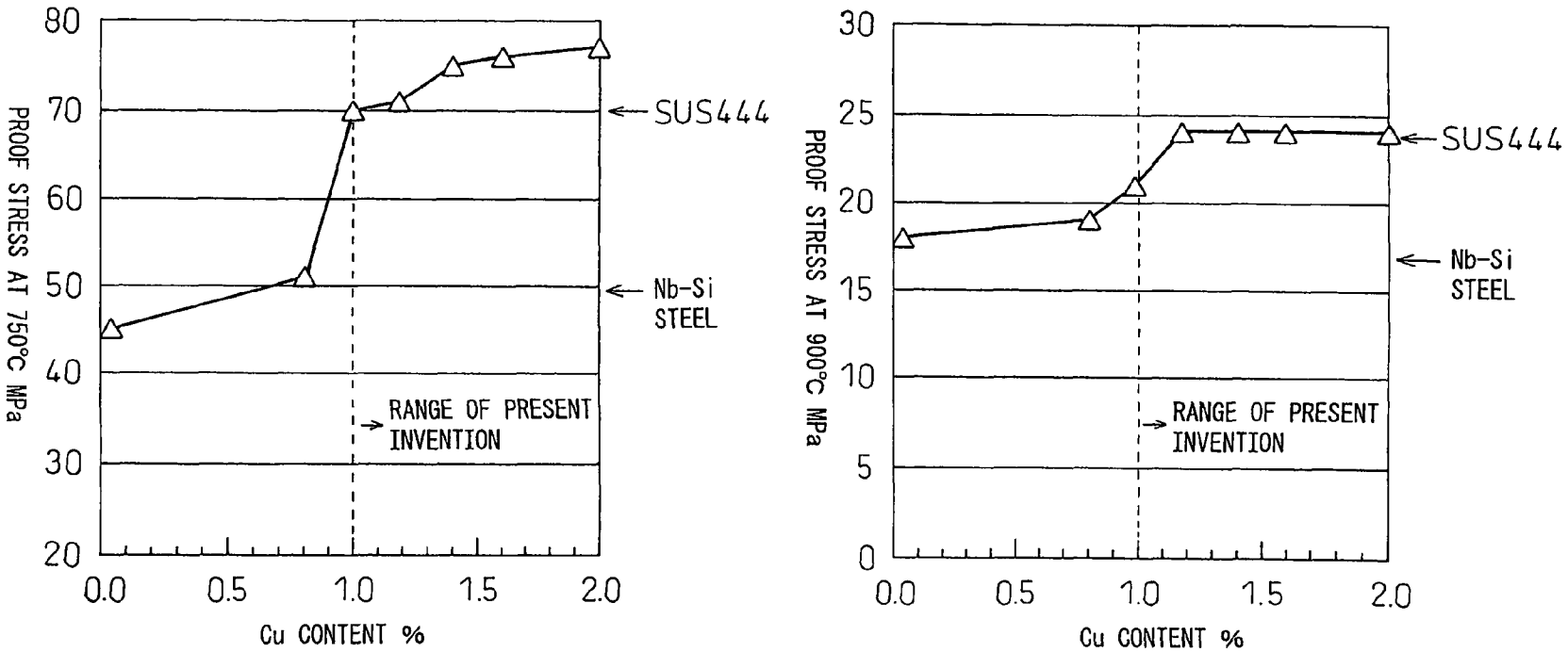
FIG. 1 is a view showing proof stress (0.2% yield strengths) at 750° C. and 900° C.
Figure 2:
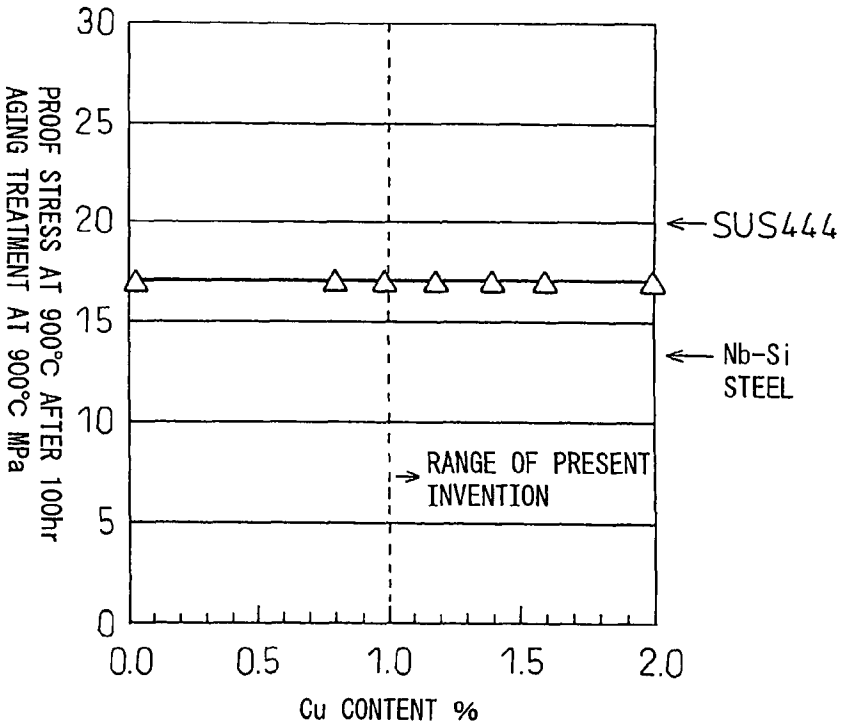
FIG. 2 is a view showing proof stress (0.2% yield strengths) at 750° C. and 900° C. after 100 hr aging heat treatment at 750° C. and 900° C.
Figure 2:
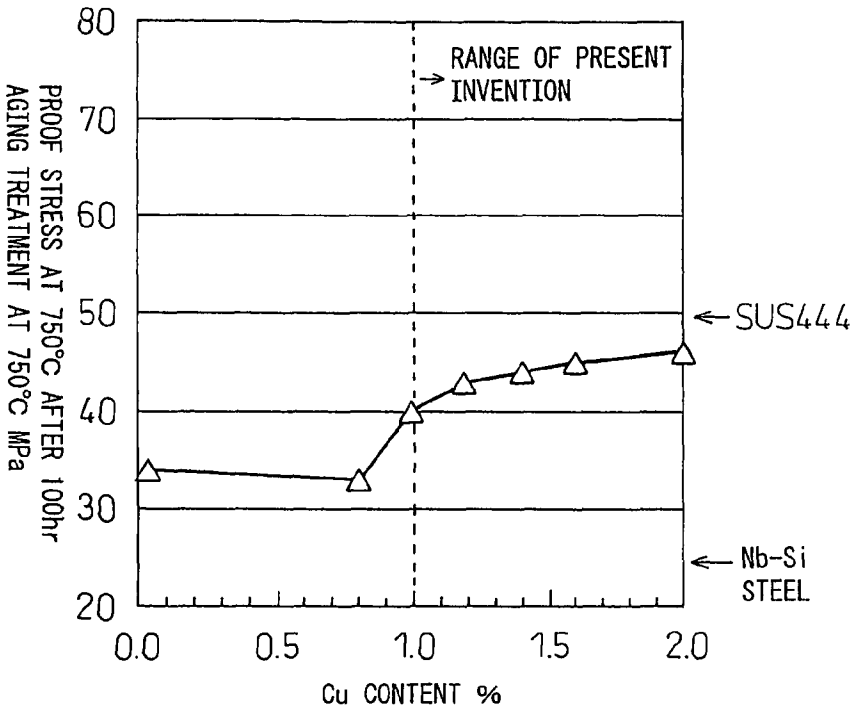

FIG. 1 shows the results of measurement of proof stress (the 0.2% yield strengths) at 750° C. and 900° C. when adding Cu in various contents to a basic composition of 18% Cr-0.003% C-0.1% Si-1% Mn-0.5% Mo-0.55Nb-0.1% Ti-0.007% N-0.001% B steel. At this time, for comparison, Nb—Si steel (14% Cr-0.003% C-1% Si-1% Mn 0.01% Mo-0.03% Cu-0.5% Nb-0.007% N) and SUS444 (19% Cr-0.005% C-0.3% Si-1% Mn-2% Mo-0.03% Cu-0.6% Nb-0.01% N) were similarly tested. Further, FIG. 2 shows 0.2% yield strengths at 750° C. and 900° C. after 100 hr aging heat treatment of the material at 750° C. and 900° C. The aging heat treatment simulates long term use of an exhaust gas member. The 100 hr of aging heat treatment corresponds to the lifetime of automobiles and other general vehicles.

From FIG. 1, it is learned that the 0.2% yield strength at 750° C. rapidly increases along with an increase in the amount of Cu of about 1% or more and that with an amount of addition of Cu of 1% or more, a 750° C. yield strength equal to or better than SUS444 is exhibited. Further, regarding the 900° C. yield strength, it is learned that while the strengthening ability of Cu is small, with an addition of Cu of 1% or more, a yield strength on a par with SUS444 is exhibited.

That is, the steel sheet of the present invention is steel lower in Mo compared with SUS444, but has a high temperature yield strength greater than that of SUS444 in the medium temperature region of 750° C. or so and the high temperature region of 900° C. or so.

Further, as shown in FIG. 2, if applying 100 hr aging heat treatment at 750° C. and 900° C., the yield strength fails compared with FIG. 1. While the yield strength is somewhat lower than SUS444, it is learned that steel containing 1% or more Cu has a much higher yield strength than Nb—Si steel. That is, when applying 100 hr of long term aging heat treatment, while somewhat lower than SUS444, a higher yield strength is maintained compared with Nb—Si steel. Here, the point is that the Mo content of the steel of the present invention is considerably smaller than with SUS444.

As factors of this phenomenon, there are the formation of the Cu precipitates due to the addition of Cu and precipitation of the Laves phase, but first off the addition of B causes these to finely precipitate and the precipitation strengthening ability to rise. These precipitates coarsen due to the aging heat treatment, but due to the addition of B, the coarsening is greatly delayed and the precipitation strengthening ability is maintained. Further, if adding Mo, the Laves phase is easily formed, but composite addition with Cu causes a rise in the solubility of Mo. Even small addition of Mo is believed to enable the amount of dissolved Mo to be secured. Regardless of having a low Mo content, due to the composite addition of Nb—Cu—B, the steel of the present invention has a higher initial yield strength at a high temperature than SUS444. Even with long term use, it is possible to maintain a higher yield strength than Nb—Si steel.

Next the reasons for limitation of the ingredients of the ferritic stainless steel sheet according to the present invention will be explained. Here, when the lower limit is not defined, it shows inclusion up to the level of an unavoidable impurity.

C degrades the formability and the corrosion resistance and lowers the high temperature strength, so the lower the content the better, therefore the content was made 0.01% or less. However, excessive reduction leads to an increase in the refining cost, so 0.001 to 0.005% is preferable.

N, like C, degrades the formability and corrosion resistance and lowers the high temperature strength, so the smaller the content the better. Therefore, the content was made 0.02% or less. However, excessive reduction leads to an increase in the refining cost, so 0.003 to 0.015% is preferable.

Si is an element useful as a deoxidizing agent, but is an extremely important element for improving the high temperature characteristics and oxidation resistance. The high temperature strength from the low temperature region of about 200° C. to the medium temperature region of about 750° C. is improved along with the increase in the amount of Si. The effect is exhibited at 0.05% or more. Further, Si promotes the precipitation of intermetallic compounds mainly made of Fe and Nb, called the "Laves phase", at a high temperature. The Laves phase repeatedly finely precipitates and dissolves in a heat cycle environment. When finely precipitating, the precipitation strengthening causes the high temperature strength to be improved. On the other hand, by adding over 1%, the Laves phase excessively precipitates and agglomerates and coarsens resulting in a loss of the precipitation strengthening ability, so the upper limit is made 1%. Further, regarding the oxidation resistance, if the amount of addition of Si is 1% or less, no abnormal oxidation or scale peeling is observed up to 900° C. and sufficient oxidation resistance is shown, but in the temperature region over 900° C., for example, 925° C., if the amount of addition of Si is less than 0.1, abnormal oxidation tends to easily occur, while if over 0.5%, scale peeling tends to easily occur. The assumed usage temperature is 900° C. or less, so it may be considered that there is no problem, but considering the formation of surface defects and other factors degrading the oxidation resistance, it is preferable that there be an extra margin of oxidation resistance. In this case, 0.1 to 0.5% is preferable.

Mn is an element added as a deoxidizing agent and contributes to the rise in strength in the medium temperature region of 750° C. or so. Further, during long term use, it forms Mn-based oxides at the surface and contributes to scale adhesion and an abnormal oxidation suppression effect. This effect is exhibited at 0.1% or more. On the other hand, excessive addition of over 2% lowers the uniform elongation at ordinary temperature and forms MnS to lower the corrosion resistance and degrade the oxidation resistance. From these viewpoints, the upper limit was made 2%. Furthermore, if considering high temperature ductility and scale adhesion, 0.3 to 1.5% is preferable.

Cr is an element essential for securing oxidation resistance in the present invention. If less than 10%, that effect is not expressed, while if over 30%, the workability is lowered or the toughness is degraded, so the content was made 10 to 30%. Furthermore, if considering the high temperature ductility and production cost, 13.5 to 19% is preferable.

Mo improves the corrosion resistance and is effective for controlling the high temperature oxidation and improving the high temperature strength due to solution strengthening. However, it is expensive and lowers the uniform elongation at ordinary temperature. Further, excessive addition promotes the coarse precipitation of the Laves phase and lowers the precipitation strengthening ability in the medium temperature region. In the Nb—Cu—B steel of the present invention, an increase in the dissolved Mo is obtained by addition of Cu and increased fineness of the Laves phase by the addition of B is obtained by the addition of 0.1% or more of Mo, so the lower limit was made 0.1%. Excessive addition over 1% promotes coarsening of the Laves phase so does not contribute to the high temperature strength and leads to an increase in cost, so the upper limit was made 1%. Furthermore, if considering the producibility, cost, and stability of strength in a high temperature region such as 900° C., 0.2 to 0.5% is preferable.

Ti is an element bonding with C, N, and S to improve the corrosion resistance, grain boundary corrosion resistance, and the r value indicating the deep drawability. Further, in composite addition with Nb, addition of a suitable amount improves the high temperature strength, improves the high temperature ductility, and improves the heat fatigue characteristics. These effects are exhibited from 0.01% or more, but addition over 0.3% causes the amount of dissolved Ti to increase which lowers the uniform elongation and forms coarse Ti-based precipitates which form starting points of cracking at the time of expansion and degrade the expandability. Accordingly, the amount of addition of Ti was made 0.01 to 0.3% or less. Furthermore, if considering the occurrence of surface defects and toughness, 0.05 to 0.15% is preferable.

Nb is an element necessary for improving the high temperature strength through solution strengthening and precipitation strengthening. Further, it also functions to immobilize C and N as carbonitrides and contributes to the growth of a recrystallized structure affecting the corrosion resistance and r value of the product plate. At the medium temperature region of about 750° C., this contributes to the fine precipitation of the Laves phase, while in the high temperature region of 900° C. or so, it contributes to the solution strengthening by the dissolved Nb. This effect is exhibited with addition of 0.2% or more. On the other hand, excessive addition causes a drop in the uniform elongation and deterioration of the expandability, so the content was made 0.2 to 0.7%. Furthermore, if considering the grain boundary corrosion of the weld zone, producibility, and production cost, 0.3 to 0.6% is preferable.

B is an element improving the secondary workability at the time of press forming a product, but in the present invention, the addition of Nb—Cu causes fine precipitation of Nb-based precipitates and ϵ-Cu and contributes to improvement of the high temperature strength. In general, B easily forms $(Fe,Cr)_{23}(C,B)_6$ or $Cr_2B$ in the high temperature region, but in composite Nb—Cu steel, it is learned that these precipitates do not form and there is an effect of causing fine precipitation of the above-mentioned Laves phase and ϵ-Cu phase. The Laves phase causes a reduction of the amount of dissolved Nb and usually ends up coarser. In particular, it has almost no high temperature strengthening ability after long term aging, but addition of B causes fine precipitation, has a precipitation strengthening ability, and contributes to the improvement of the high temperature strength and increases the stability of strength at the time of long term use. Further, ϵ-Cu usually precipitates extremely finely in the initial period of precipitation and has a large strength improving effect, but coarsens due to aging heat treatment and results in a large drop in strength after aging. However, due to the addition of B, coarsening of ϵ-Cu is suppressed and the stability of strength at the time of use becomes higher. The mechanism behind the effect of the addition of B in increasing the fineness of precipitation and suppressing coarsening is not clear, but it is believed that the grain boundary segregation of B causes a drop in the interfacial energy, suppresses the grain boundary precipitation of the Laves phase and ϵ-Cu, and causes fine precipitation in the grains. Further, it is deduced that suppression of the grain boundary diffusion of Nb and Cu suppresses the coarsening of these precipitates. These effects are exhibited at 0.0002% or more, but excessive addition causes hardening or worse grain boundary corrosion and results in weld cracks, so the content was made 0.0002 to 0.0050%. Furthermore, if considering the formability and production costs, 0.0003 to 0.0015% is preferable.

Cu is an element effective for improving the high temperature strength in the medium temperature region near 750° C. This is a precipitation hardening action resulting from the precipitation of ϵ-Cu and is exhibited with addition of 1% or more. On the other hand, excessive addition results in a drop in uniform elongation, an overly high ordinary temperature yield strength, and obstruction of press formability. Further, if 2% or more is added, an austenite phase is formed in the high temperature-region and abnormal oxidation occurs at the surface, so the upper limit was made 2%. If considering the producibility and scale adhesion, 1 to 1.5% is preferable.

Al is an element added as a deoxidizing element and improving the oxidation resistance. Further, it is useful as a solution strengthening element for improving the strength at 750 to 900° C. This action is exhibited stably from 0.01%, but excessive addition results in hardening and a remarkable drop in the uniform elongation and, further, a remarkable drop in the toughness, so the upper limit was made 3%. Furthermore, if considering the occurrence of surface defects and the weldability and producibility, 0.01 to 2.5% is preferable.

V forms fine carbonitrides, has a precipitation strengthening action, and contributes to improvement of the high temperature strength. This effect is exhibited stably by addition of 0.01% or more, but if over 1% is added, the precipitate coarsens, the high temperature strength falls, and the heat fatigue lifetime ends up falling, so the upper limit was made 1%. Furthermore, if considering the production cost and producibility, 0.08 to 0.5% is preferable.

W has a similar effect as Mo and is an element improving the high temperature strength. This effect is exhibited stably at 1% or more, but if excessively added, W dissolves in the Laves phase and ends up causing coarsening of the precipitate and degrading of the producibility, so 1 to 3% is preferable. Furthermore, if considering the cost and oxidation resistance etc., 1.2 to 2.5% is preferable.

Sn is an element with a large atomic radius and effective for solution strengthening and does not cause major degradation of the ordinary temperature mechanical characteristics. A contribution to high temperature strength is stably realized if 0.1% or more, but if 1% or more is added, the producibility becomes remarkably degraded, so 0.1 to 1% is preferable. Furthermore, if considering the oxidation resistance etc., 0.2 to 0.8% is preferable.

Zr, like Ti and Nb, is a carbonitride forming element and contributes to improvement of the high temperature strength due to the increase in amounts of dissolved Ti and Nb and improvement of the oxidation resistance. The effect is exhibited stably by addition of 0.2% or more. However, by adding over 1%, the producibility remarkably deteriorates, so the content was made 0.2 to 1%. Furthermore, if considering the costs and surface quality, 0.2 to 0.9% is preferable.

EXAMPLES

Steel of each of the compositions of ingredients shown in Table 1 and Table 2 was produced and the slab hot rolled to obtain a 5 mm thick hot rolled coil. After this, the hot rolled coil was pickled, then cold rolled to a 2 mm thickness, then was annealed and pickled to obtain the product sheet. The annealing temperature of the cold rolled sheets was made 980 to 1070° C. to give a crystal grain size no. of 6 to 8 or so. Nos. 1 to 13 in Table 1 are invention steels, while Nos. 14 to 34 in Table 2 are comparative steel sheets. Among the comparative steel sheets, No. 33 is Nb—Si steel sheet, while No. 34 is steel sheet with a record of use as SUS444 steel sheet. From the thus obtained product sheets, high temperature tensile test pieces were obtained and tested by tensile tests at 750° C. and 900° C. to measure the 0.2% yield strength (based on JIS G0567). Further, they were aged at 750° C. and 900° C. for 100 hours, then subjected to a high temperature tensile test in the same way as the above. Furthermore, as the test of the oxidation resistance, a continuous oxidation test was conducted in the atmosphere at 900° C. and 950° C. for 200 hr and the presence of any abnormal oxidation or scale peeling was evaluated (based on JIS Z2281). For the ordinary temperature workability, a JIS No. 13B test piece was prepared, subjected to a tensile test in the rolling direction and parallel direction, and measured for elongation at break. Here, if the elongation at break at ordinary temperature is 30% or more, working into general exhaust parts is possible, so a 30% or more elongation at break is preferable.

TABLE 1

| | | Content of ingredients (mass %) | | | | | | | | | | | | | | |
|---|---|---|---|---|---|---|---|---|---|---|---|---|---|---|---|---|
| | No | C | Si | Mn | Cr | Mo | Cu | Ti | Nb | Al | B | N | V | W | Sn | Zr |
| Inv. | 1 | 0.004 | 0.07 | 1.0 | 18.1 | 0.15 | 1.1 | 0.09 | 0.62 | 0.008 | 0.0010 | 0.008 | — | — | — | — |
| ex. | 2 | 0.003 | 0.11 | 1.0 | 17.8 | 0.51 | 1.0 | 0.09 | 0.55 | 0.013 | 0.0008 | 0.008 | — | — | — | — |
| | 3 | 0.003 | 0.12 | 1.1 | 18.1 | 0.50 | 1.2 | 0.09 | 0.55 | 0.007 | 0.0008 | 0.008 | — | — | — | — |
| | 4 | 0.004 | 0.32 | 1.0 | 18.0 | 0.29 | 1.5 | 0.09 | 0.45 | 0.024 | 0.0006 | 0.009 | — | — | — | — |
| | 5 | 0.004 | 0.32 | 0.9 | 17.9 | 0.52 | 1.2 | 0.08 | 0.54 | 0.015 | 0.0006 | 0.009 | — | — | — | — |
| | 6 | 0.005 | 0.22 | 1.0 | 17.0 | 0.28 | 1.2 | 0.09 | 0.55 | 0.030 | 0.0007 | 0.011 | — | — | — | — |
| | 7 | 0.006 | 0.28 | 0.8 | 16.5 | 0.32 | 1.3 | 0.12 | 0.50 | 0.025 | 0.0004 | 0.010 | — | — | — | — |
| | 8 | 0.003 | 0.87 | 1.0 | 14.1 | 0.51 | 1.7 | 0.10 | 0.55 | 0.008 | 0.0008 | 0.008 | — | — | — | — |
| | 9 | 0.003 | 0.25 | 0.9 | 18.5 | 0.90 | 1.1 | 0.09 | 0.51 | 2.0 | 0.0009 | 0.012 | — | — | — | — |
| | 10 | 0.003 | 0.15 | 0.9 | 17.8 | 0.45 | 1.3 | 0.12 | 0.49 | 0.013 | 0.0007 | 0.013 | 0.5 | — | — | — |
| | 11 | 0.003 | 0.88 | 1.2 | 13.2 | 0.32 | 1.0 | 0.06 | 0.68 | 0.013 | 0.0013 | 0.016 | — | 2.5 | — | — |
| | 12 | 0.003 | 0.31 | 1.0 | 17.8 | 0.90 | 1.2 | 0.09 | 0.60 | 0.010 | 0.0015 | 0.015 | — | — | 0.4 | — |
| | 13 | 0.003 | 0.89 | 1.0 | 13.9 | 0.20 | 1.4 | 0.09 | 0.54 | 0.007 | 0.0008 | 0.008 | — | — | — | 0.5 |

| | No | 750° C. 0.2% yield strength MPa | 900° C. 0.2% yield strength MPa | 750° C. 0.2% yield strength after 100 hr aging heat treatment at 750° C. MPa | 900° C. 0.2% yield strength after 100 hr aging heat treatment at 900° C. MPa | Abnormal oxidation or scale peeling after 200 hr continuous oxidation test at 900° C. | Abnormal oxidation or scale peeling after 200 hr continuous oxidation test at 950° C. | Ordinary temperature elongation at break % |
|---|---|---|---|---|---|---|---|---|
| Inv. | 1 | 70 | 20 | 40 | 16 | No | Yes | 35 |
| ex. | 2 | 71 | 22 | 41 | 17 | No | No | 33 |
| | 3 | 71 | 24 | 43 | 17 | No | No | 32 |
| | 4 | 70 | 22 | 40 | 16 | No | No | 34 |
| | 5 | 74 | 23 | 43 | 16 | No | No | 33 |
| | 6 | 73 | 23 | 43 | 16 | No | No | 34 |
| | 7 | 72 | 22 | 42 | 16 | No | No | 34 |

TABLE 1-continued

| | | | | | | | |
|---|---|---|---|---|---|---|---|
| 8 | 71 | 21 | 42 | 20 | No | Yes | 31 |
| 9 | 76 | 28 | 50 | 25 | No | No | 32 |
| 10 | 71 | 23 | 50 | 20 | No | No | 33 |
| 11 | 72 | 23 | 52 | 21 | No | Yes | 34 |
| 12 | 75 | 26 | 51 | 25 | No | No | 34 |
| 13 | 71 | 22 | 50 | 20 | No | No | 36 |

TABLE 2

| | | Content of ingredients (mass %) | | | | | | | | | | | | | | |
|---|---|---|---|---|---|---|---|---|---|---|---|---|---|---|---|---|
| No | | C | Si | Mn | Cr | Mo | Cu | Ti | Nb | Al | B | N | V | W | Sn | Zr |
| Comp. ex. | 14 | 0.015 | 0.21 | 0.8 | 17.8 | 0.10 | 1.1 | 0.11 | 0.51 | 0.011 | 0.0009 | 0.015 | — | — | — | — |
| | 15 | 0.007 | 0.21 | 0.8 | 17.8 | 0.10 | 1.1 | 0.11 | 0.51 | 0.011 | 0.0009 | 0.030 | — | — | — | — |
| | 16 | 0.005 | 2.00 | 0.9 | 18.5 | 0.12 | 1.2 | 0.07 | 0.48 | 0.009 | 0.0009 | 0.014 | — | — | — | — |
| | 17 | 0.006 | 0.15 | 2.5 | 14.5 | 0.52 | 1.3 | 0.10 | 0.45 | 0.006 | 0.0009 | 0.011 | — | — | — | — |
| | 18 | 0.007 | 0.18 | 1.1 | 11.5 | 0.65 | 1.0 | 0.12 | 0.48 | 0.015 | 0.0010 | 0.016 | — | — | — | — |
| | 19 | 0.009 | 0.20 | 1.2 | 22.0 | 0.65 | 1.2 | 0.12 | 0.53 | 0.012 | 0.0010 | 0.013 | — | — | — | — |
| | 20 | 0.003 | 0.07 | 1.0 | 17.0 | 0.03 | 1.1 | 0.06 | 0.51 | 0.0 | 0.0009 | 0.011 | — | — | — | — |
| | 21 | 0.003 | 0.11 | 1.0 | 17.5 | 0.50 | 0.8 | 0.09 | 0.42 | 0.025 | 0.0009 | 0.015 | — | — | — | — |
| | 22 | 0.003 | 0.11 | 1.0 | 17.5 | 0.50 | 2.2 | 0.09 | 0.42 | 0.025 | 0.0009 | 0.015 | — | — | — | — |
| | 23 | 0.004 | 0.15 | 0.9 | 17.8 | 0.25 | 1.2 | 0.005 | 0.60 | 0.015 | 0.0010 | 0.015 | — | — | — | — |
| | 24 | 0.005 | 0.15 | 1.0 | 17.6 | 0.28 | 1.2 | 0.35 | 0.55 | 0.012 | 0.0010 | 0.012 | — | — | — | — |
| | 25 | 0.004 | 0.13 | 1.0 | 15.2 | 0.10 | 1.2 | 0.15 | 0.10 | 0.015 | 0.0010 | 0.015 | — | — | — | — |
| | 26 | 0.004 | 0.07 | 1.0 | 16.2 | 0.10 | 1.2 | 0.14 | 0.90 | 0.020 | 0.0009 | 0.012 | — | — | — | — |
| | 27 | 0.003 | 0.13 | 1.2 | 18.2 | 0.22 | 1.2 | 0.09 | 0.51 | 0.008 | 0.0001 | 0.010 | — | — | — | — |
| | 28 | 0.003 | 0.13 | 1.2 | 18.2 | 0.22 | 1.2 | 0.09 | 0.51 | 0.008 | 0.0080 | 0.010 | — | — | — | — |
| | 29 | 0.004 | 0.15 | 1.0 | 18.1 | 0.22 | 1.1 | 0.09 | 0.46 | 0.008 | 0.0010 | 0.007 | 1.5 | — | — | — |
| | 30 | 0.005 | 0.35 | 0.8 | 17.9 | 0.53 | 1.2 | 0.12 | 0.52 | 0.013 | 0.0007 | 0.008 | — | 3.5 | — | — |
| | 31 | 0.006 | 0.77 | 1.0 | 14.2 | 0.10 | 1.0 | 0.09 | 0.51 | 0.011 | 0.0009 | 0.013 | — | — | 2.0 | — |
| | 32 | 0.004 | 0.11 | 1.2 | 17.5 | 0.15 | 1.1 | 0.15 | 0.39 | 0.015 | 0.0010 | 0.015 | — | — | — | 2.0 |
| | 33 | 0.003 | 0.32 | 1.0 | 18.5 | 1.80 | 0.03 | 0.07 | 0.60 | 0.015 | 0.0010 | 0.012 | — | — | — | — |
| | 34 | 0.003 | 0.11 | 1.0 | 13.8 | 0.50 | 0.03 | 0.09 | 0.35 | 0.013 | 0.0008 | 0.008 | — | — | — | — |

| No | | 750° C. 0.2% yield strength MPa | 900° C. 0.2% yield strength MPa | 750° C. 0.2% yield strength after 100 hr aging heat treatment at 750° C. MPa | 900° C. 0.2% yield strength after 100 hr aging heat treatment at 900° C. MPa | Abnormal oxidation or scale peeling after 200 hr continuous oxidation test at 900° C. | Abnormal oxidation or scale peeling after 200 hr continuous oxidation test at 950° C. | Ordinary temperature elongation at break % |
|---|---|---|---|---|---|---|---|---|
| Comp. ex. | 14 | 60 | 15 | 31 | 10 | Yes | Yes | 29 |
| | 15 | 61 | 16 | 32 | 11 | Yes | Yes | 29 |
| | 16 | 68 | 20 | 38 | 15 | Yes | Yes | 28 |
| | 17 | 70 | 20 | 40 | 15 | Yes | Yes | 29 |
| | 18 | 62 | 16 | 35 | 10 | Yes | Yes | 35 |
| | 19 | 72 | 22 | 42 | 17 | No | No | 28 |
| | 20 | 67 | 18 | 35 | 13 | Yes | Yes | 32 |
| | 21 | 50 | 18 | 35 | 16 | No | No | 35 |
| | 22 | 74 | 23 | 43 | 17 | Yes | Yes | 27 |
| | 23 | 68 | 16 | 38 | 14 | No | No | 35 |
| | 24 | 72 | 21 | 42 | 17 | No | No | 28 |
| | 25 | 30 | 14 | 20 | 10 | No | Yes | 27 |
| | 26 | 72 | 24 | 42 | 17 | No | Yes | 27 |
| | 27 | 70 | 18 | 39 | 14 | No | No | 35 |
| | 28 | 72 | 22 | 42 | 16 | No | No | 29 |
| | 29 | 75 | 23 | 52 | 20 | No | No | 28 |
| | 30 | 80 | 28 | 55 | 21 | No | No | 27 |
| | 31 | 82 | 30 | 60 | 23 | No | Yes | 25 |
| | 32 | 73 | 26 | 43 | 25 | No | No | 28 |
| | 33 | 70 | 20 | 50 | 15 | NO | No | 28 |
| | 34 | 40 | 19 | 34 | 14 | No | No | 35 |

As clear from Table 1 and Table 2, it is learned that when producing steel sheet having the composition of ingredients prescribed in the present invention by an ordinary method such as the above, the high temperature yield strength at 750° C. to 900° C. is higher than the comparative examples, there is no abnormal oxidation or scale peeling at 900° C., and the oxidation resistance is also superior. Further, in the mechanical properties at ordinary temperature, it is learned that the breakage ductility is a high 30% or more and the workability is superior to that of the comparative steels. Further, it is learned that with the exception of the No. 1 steel sheet where the amount of Si is less than 0.1% and the No. 8 steel sheet and No. 11 steel sheet where the Si is over 0.5%, the oxidation resistance at 950° C. is also superior. The comparative steels of the Nos. 14, 15, 16, 18, 20, 21, 22, 23, and 25 steel sheets have initial yield strengths at 750° C. and 900° C. lower than the invention steel sheets. The No. 17 steel sheet has Mn excessively added and therefore is inferior in oxidation resistance and low in ductility at ordinary temperature. The No. 19 steel sheet has Cr outside the upper limit and so has a good high temperature yield strength, but a low ordinary temperature ductility. The No. 22 steel sheet has Cu outside the upper limit, so has a good high temperature yield strength, but a low ordinary temperature ductility and an inferior oxidation resistance as well. The No. 26 steel sheet has an Nb outside the upper limit, so has a good high temperature yield strength, but a low ordinary temperature ductility. The No. 27 steel sheet has a B outside the lower limit, so has a high initial yield strength at 750° C., but has a low 900° C. yield strength and a low yield strength after aging heat treatment. The No. 28 steel sheet has a B outside the upper limit and so has a low ductility at ordinary temperature. The Nos. 29 to 32 steel sheets have amounts of addition of V, W, Sn, and W outside the upper limit so have good high temperature strengths, but low ordinary temperature ductilities and obstruct working into parts. The No. 33 steel sheet is SUS444 which has a high temperature strength, but has a low ductility and has a large amount of Mo added to it, so becomes high in cost. The Nb—Si steel of the No. 34 steel sheet has a low high temperature yield strength.

Note that the method of production of the steel sheet is not particularly limited. The hot rolling conditions, the hot rolled plate thickness, the presence of any hot rolled sheet annealing, the cold rolling conditions, and annealing temperatures of the hot rolled sheet and cold rolled sheet, atmosphere, etc. may be suitably selected. Further, the steel may be patent rolled or given a tension leveler after cold rolling and annealing as well. Furthermore, the product sheet thickness may be selected in accordance with the required member thickness.

INDUSTRIAL APPLICABILITY

The steel sheet according to the present invention, even if not particularly adding a large amount of expensive Mo, high temperature characteristics close to SUS444 are obtained. In particular, by applying the invention to the exhaust system parts of automobiles etc., it is possible to obtain major effects in terms of measures for the environment and reduction of costs of parts.

The invention claimed is:

1. Ferritic stainless steel sheet containing, by mass %, C: 0.01% or less, N: 0.02% or less, Si: 0.05 to 1%, Mn: 0.8 to 2%, Cr: 13.2 to 19%, Mo: 0.1 to 1%, Cu: 1 to 2%, Nb: 0.51 to 0.7%, Ti: 0.01 to 0.3%, and B: 0.0002 to 0.0050%, having a balance of Fe and unavoidable impurities, and having a 0.2% yield strength at 750° C. of 70 MPa or more and an elongation at break of the steel sheet at ordinary temperature of 30% or more.

2. Ferritic stainless steel sheet as set forth in claim 1 further containing, by mass %, one or more of Al: 3% or less, V: 1% or less, W: 3% or less, Sn: 1% or less, and Zr: 1% or less.

3. Ferritic stainless steel sheet as set forth in claim 1 wherein the 0.2% yield strength at 900° C. is 20 MPa or more.

4. Ferritic stainless steel sheet as set forth in claim 1 wherein the 0.2% yield strength at 750° C. after 100 hr aging heat treatment at 750° C. is 40 MPa or more and the 0.2% yield strength at 900° C. after 100 hr aging heat treatment at 900° C. is 15 MPa or more.

5. Ferritic stainless steel sheet as set forth in claim 1 containing Cr: 13.2 to 18.5%.

6. Ferritic stainless steel sheet as set forth in claim 1 containing Cr: 13.5 to 19%.

7. An exhaust gas system member of an automobile, comprising the ferritic stainless steel sheet as set forth in any of claims 1 to 4 and 5-6.

8. The exhaust gas system member of claim 7, wherein said exhaust gas system member is selected from the group consisting of an exhaust manifold, front pipe, and center pipe.

* * * * *